US011283205B2

(12) United States Patent
Sakai et al.

(10) Patent No.: US 11,283,205 B2
(45) Date of Patent: Mar. 22, 2022

(54) BOARD CONNECTOR AND CONNECTOR WITH BOARD

(71) Applicant: Sumitomo Wiring Systems, Ltd., Yokkaichi (JP)

(72) Inventors: Hiroto Sakai, Yokkaichi (JP); Hidekazu Matsuda, Yokkaichi (JP); Yuichi Nakanishi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 16/915,967

(22) Filed: Jun. 29, 2020

(65) Prior Publication Data

US 2021/0021063 A1 Jan. 21, 2021

(30) Foreign Application Priority Data

Jul. 16, 2019 (JP) ..... JP2019-130848

(51) Int. Cl.
*H01R 12/57* (2011.01)

(52) U.S. Cl.
CPC ..... *H01R 12/57* (2013.01)

(58) Field of Classification Search
CPC .... H01R 12/57; H01R 12/724; H01R 12/727; H01R 12/79; H01R 13/05
See application file for complete search history.

(56) References Cited

U.S. PATENT DOCUMENTS 4,264,114 A * 4/1981 Chandler ..... H01R 12/724 439/62
5,257,950 A * 11/1993 Lenker ..... H01R 13/7195 333/185
5,547,384 A * 8/1996 Benjamin ..... H01R 12/57 439/79
5,580,269 A * 12/1996 Fan ..... H01R 12/716 439/79
5,788,539 A * 8/1998 Fedder ..... H01R 4/2429 439/682
6,227,867 B1 * 5/2001 Chen ..... H01R 12/57 29/842
6,431,882 B1 * 8/2002 Noda ..... H01R 13/658 439/79

(Continued)

FOREIGN PATENT DOCUMENTS

JP 11-86987 3/1999

*Primary Examiner* — Truc T Nguyen
(74) *Attorney, Agent, or Firm* — Gerald E. Hespos; Michael J. Porco; Matthew T. Hespos

(57) ABSTRACT

A board connector (20) is provided with first terminals (30), second terminals (40) and a housing (21) including a wall (23) for holding the first and second terminals (30, 40). The first terminal 30 includes a first extending portion (35) extending out from the wall (23), and the second terminal 40 includes a second extending portion (45) extending out from the wall (23). The first extending portion (35) includes a first connecting portion (38) that can be soldered to a land (12A) of a board (11). The second extending portion (45) includes a second connecting portion (49) that can be soldered to a land (12B) of the board (11) at a position more distant from the wall (23) than the first connecting portion (38) and a bent portion (48) is bent to approach the first connecting portion (38) at a position not overlapping the first connecting portion (38).

2 Claims, 9 Drawing Sheets

(56) References Cited

U.S. PATENT DOCUMENTS

| | | | | |
|---|---|---|---|---|
| 6,932,649 | B1 * | 8/2005 | Rothermel | H01R 13/6658 439/620.01 |
| 2004/0115971 | A1 * | 6/2004 | Nose | H05K 3/308 439/79 |
| 2012/0064743 | A1 * | 3/2012 | Qin | H01R 13/6471 439/92 |
| 2015/0200504 | A1 * | 7/2015 | Little | H01R 24/60 439/345 |
| 2016/0006182 | A1 * | 1/2016 | Patel | H01R 13/6597 439/108 |
| 2017/0365954 | A1 * | 12/2017 | Chen | H01R 13/6585 |
| 2018/0277985 | A1 * | 9/2018 | Tsai | H01R 13/5216 |

* cited by examiner

BOARD CONNECTOR AND CONNECTOR WITH BOARD

BACKGROUND

Field of the Invention

A board connector and a connector with board are disclosed in this specification.

Related Art

Japanese Unexamined Patent Publication No. H11-86987 discloses a board connector with metal contacts fixed in upper and lower stages in an insulator. Connecting portions of the contacts are disposed behind the insulator and are soldered to lands arranged in one row on a surface of a board. Soldered locations are inspected from above by an image sensor or the like.

In recent years, further miniaturization of board connectors has been required. Miniaturization could be achieved by narrowing intervals between adjacent terminals, but predetermined intervals for ensuring insulation are necessary between adjacent the terminals. On the other hand, if lands of a board to which terminals are soldered are arranged in rows, the positions of the lands in adjacent rows are shifted from each other in a zigzag pattern and the terminals are soldered to the lands arranged in the zigzag pattern, thereby increasing the density of the terminals and miniaturizing the board connector.

Locations where the terminals of the board connector are soldered to the board generally are inspected, such as by capturing an image, to check whether or not soldering has been performed satisfactorily. However, there is a concern that shifting lands of adjacent rows will reduce inspection accuracy. More particularly, there will be a different depth of focus for the solder fillets of the lands close to the housing as compared to the solder fillets of the lands farther from the housing. These different depths of focus can cause image blurring that can affect inspection accuracy in a configuration in which the lands in adjacent rows are shifted in a zigzag pattern.

SUMMARY

A board connector described in this specification has a first terminal, a second terminal and a housing including a wall for holding the first and second terminals. The first terminal includes a first extending portion extending out from the wall, and the second terminal includes a second extending portion extending out from the wall. The first extending portion includes a first connecting portion that can be soldered to a land of a board, and the second extending portion includes a second connecting portion that can be soldered to a land of the board at a position more distant from the wall than the first connecting portion and a bent portion to approach the first connecting portion at a position not overlapping the first connecting portion. According to this configuration, a difference in depth of focus between a soldered part of the first connecting portion and the second extending portion can be reduced when inspecting for soldering on a surface of the board by the bent portion of the second extending portion. Thus, a reduction in inspection accuracy due to the difference in depth of focus can be suppressed.

The bent portion may extend along an extending direction of the first connecting portion. Thus, the difference in depth of focus can be reduced in a region within an extending range of the bent portion, and inspection accuracy due to the difference in depth of focus can be improved while the first and second terminals are insulated from each other.

The first connecting portion of one embodiment includes a plated portion having an outer surface plated and an exposing portion. A cut metal surface is exposed in the exposing portion, and the plated portion is soldered. Soldering the plated portion provides better soldering than soldering the cut metal surface.

A connector with board has the above-described board connector and a board to which the first and second terminals are soldered.

Accordingly, there is no reduction in inspection accuracy due to a difference in depth of focus during an inspection for soldering.

DETAILED DESCRIPTION

A specific example of the board connector of the present disclosure is described below with reference to FIGS. 1 to 9. Note that the disclosure is not limited to these illustrations and is intended to be represented by claims and include all changes in the scope of claims and in the meaning and scope of equivalents.

Figure 1:
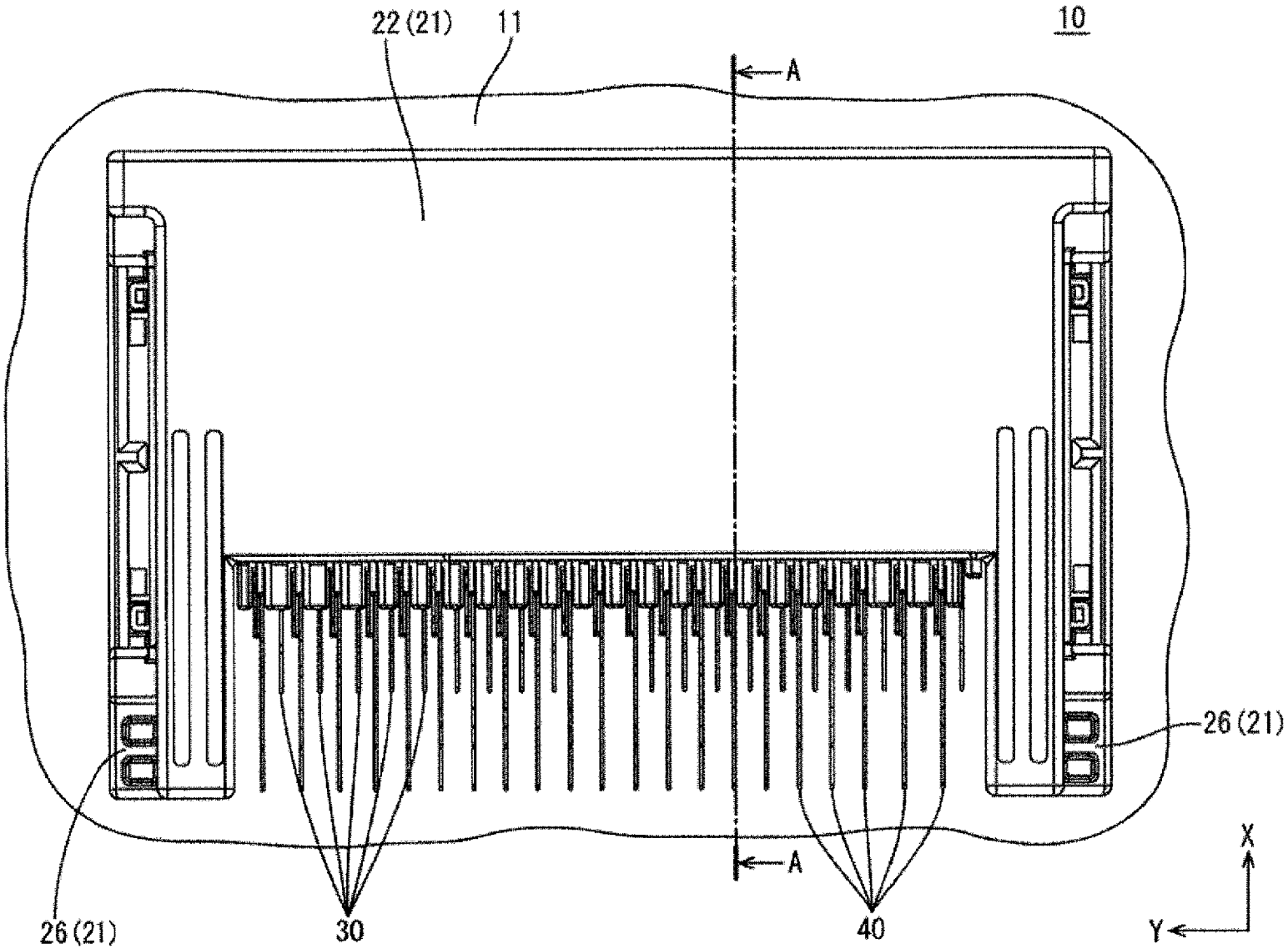
FIG. 1 is a plan view showing a connector with board.

A connector with board 10 of this embodiment is mounted in a vehicle such as an automotive vehicle and fit and connected to a mating connector connected to end parts or the like of wires routed in the vehicle. The connector with board 10 can be arranged in an arbitrary orientation. An X direction and a Y direction of FIG. 1 are referred to as a forward direction and a leftward direction and a Z direction of FIG. 3 is referred to as an upward direction in the following description.

(Connector with Board 10)

Figure 3:
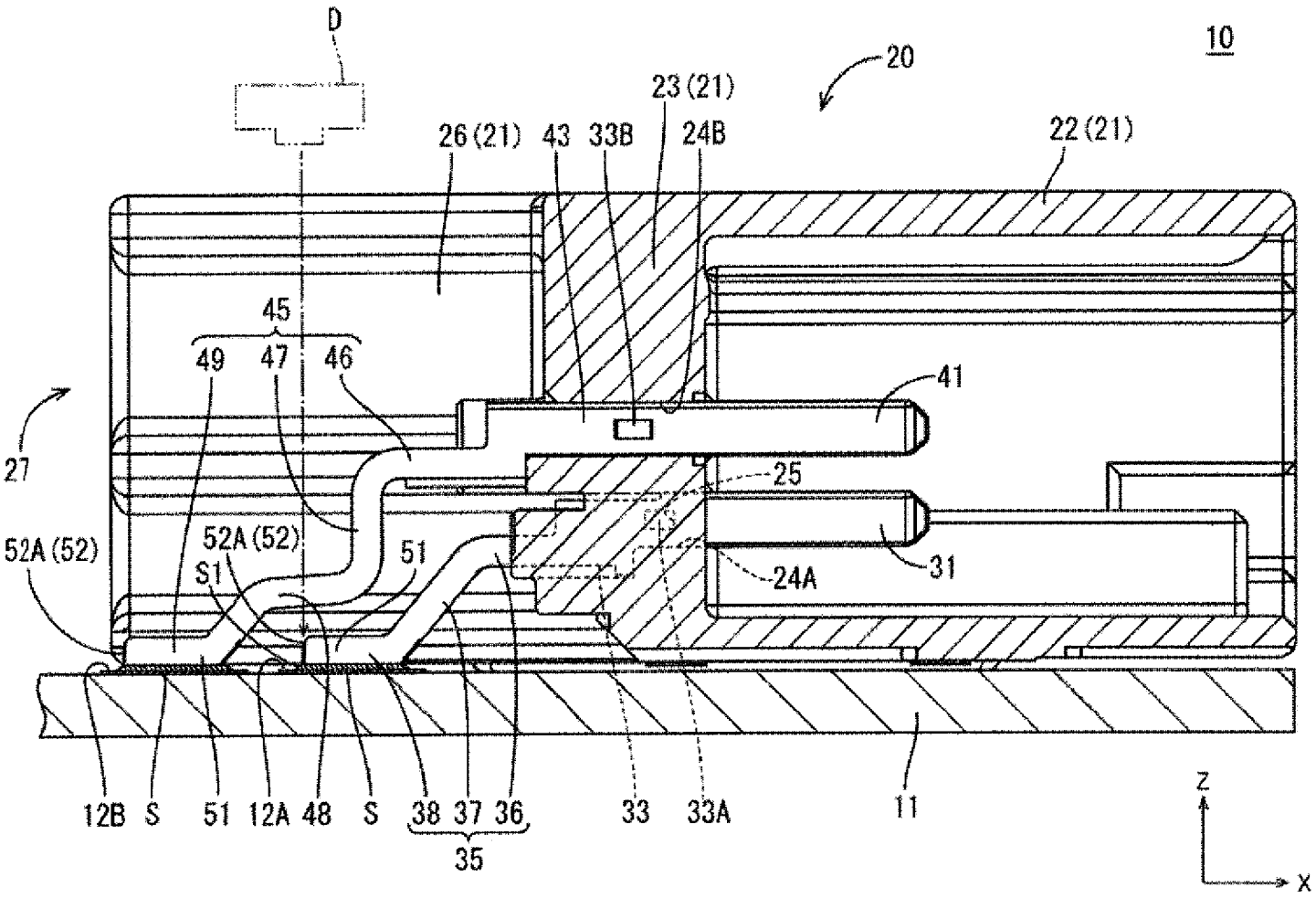
FIG. 3 is a section along A-A of FIG. 1.

The connector with board 10 includes a board 11 and a board connector 20 to be mounted on the board 11, as shown in FIG. 3.

The board 11 is a printed board with conductive paths made of copper foil or the like formed on an insulating plate by a printed wiring technique. Unillustrated electronic components are mounted on the board 11.

Figure 2:
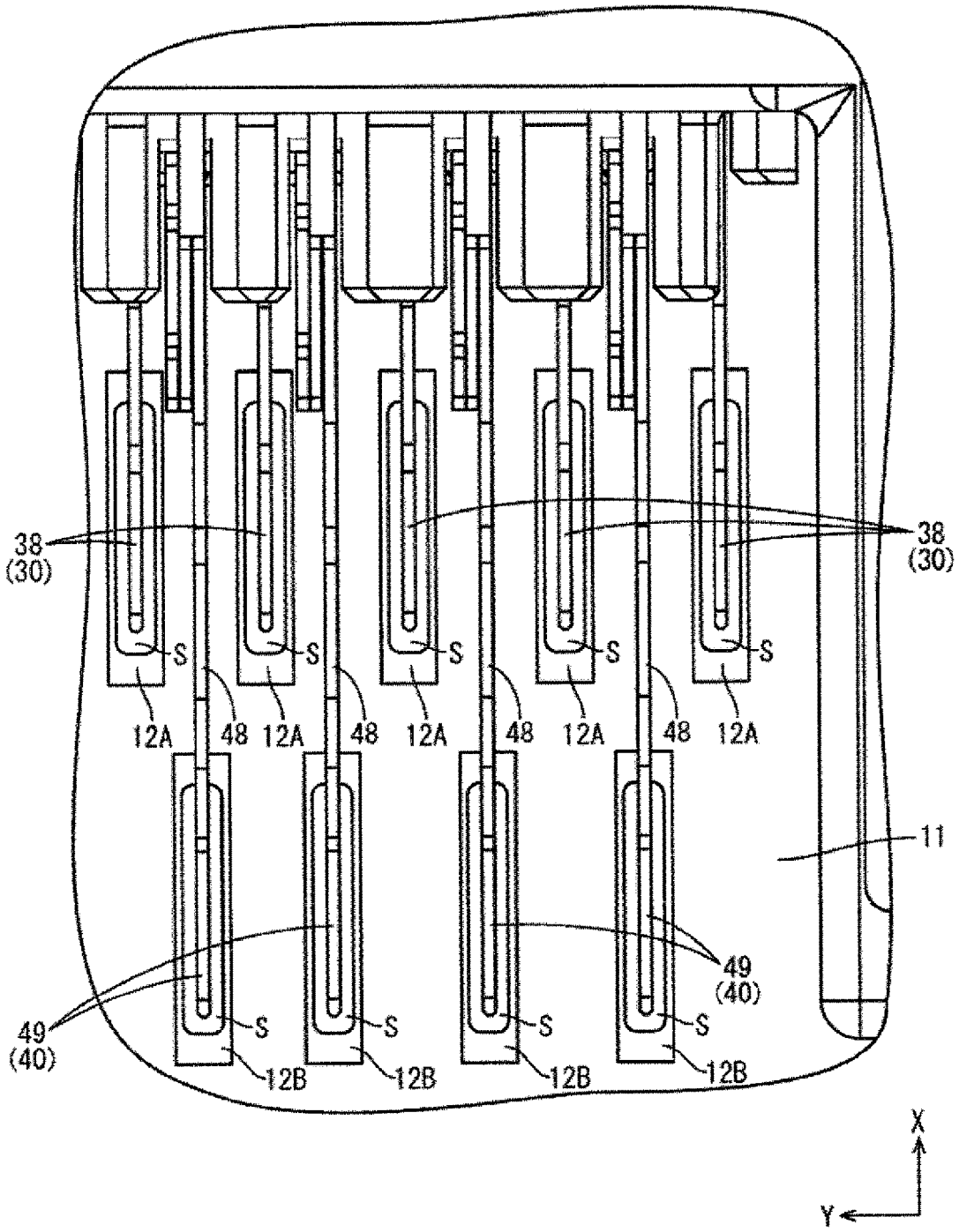
FIG. 2 is a view enlargedly showing a part of FIG. 1.

Lands 12A, 12B are formed on the conductive paths on the upper surface of the board 11, and terminals can be soldered to the lands 12A, 12B. As shown in FIG. 2, the lands 12A, 12B are formed side by side in rows (two rows in this embodiment) in a front-rear direction and include first lands 12A arranged in a first row along the rear end (peripheral edge) of the board 11 and second lands 12B arranged in a second row on a rear side while being spaced apart from the first lands 12A. The second lands 12B are arranged in intermediate parts between adjacent first lands 12A in a lateral direction. In this way, the lands 12A, 12B are arranged in a zigzag pattern and insulation between the lands 12A, 12B (and the terminals 30, 40) adjacent in the front-rear, lateral and oblique directions is ensured.

(Board Connector 20)

Figure 5:
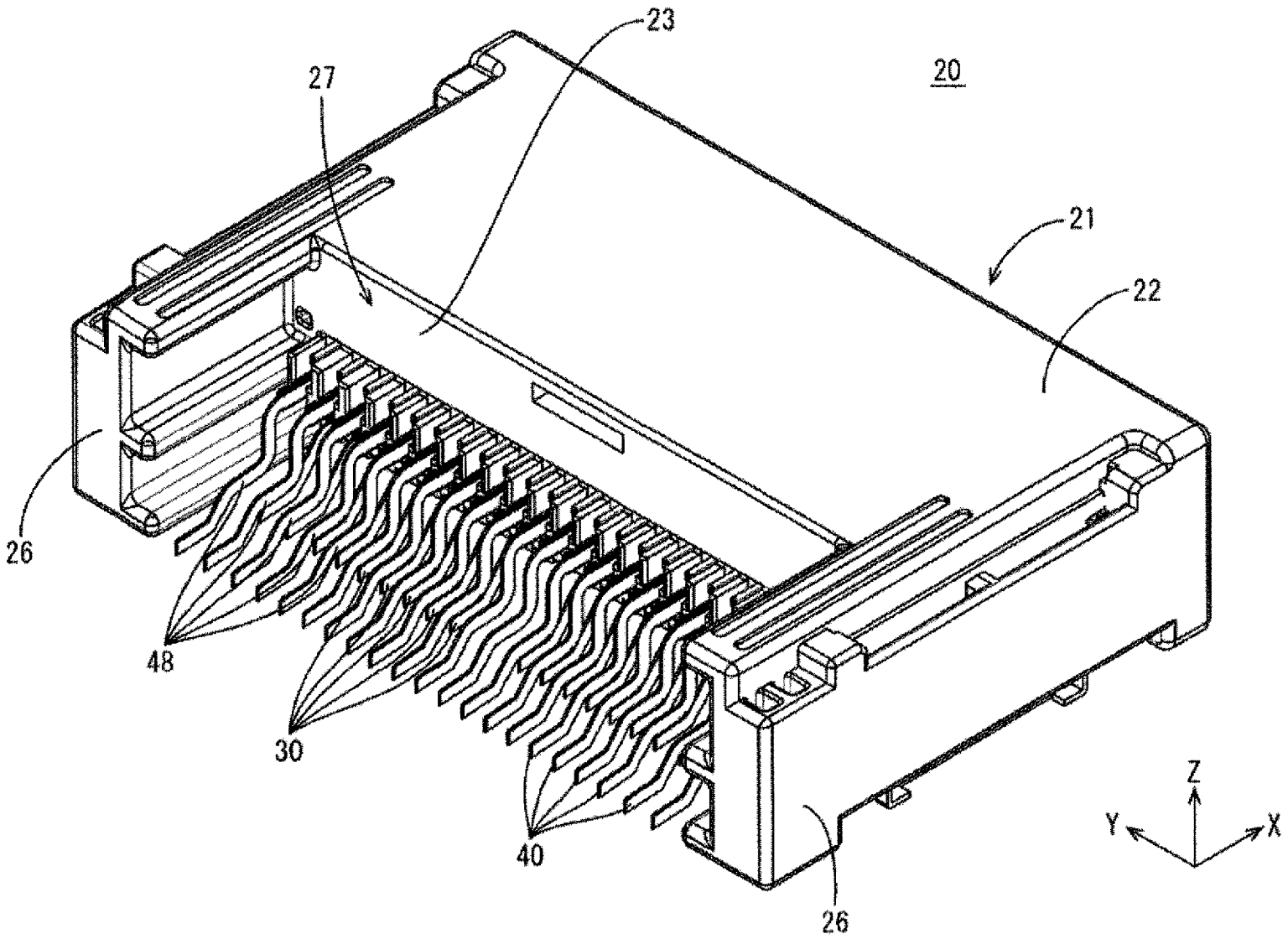
FIG. 5 is a perspective view showing a board connector.
Figure 6:
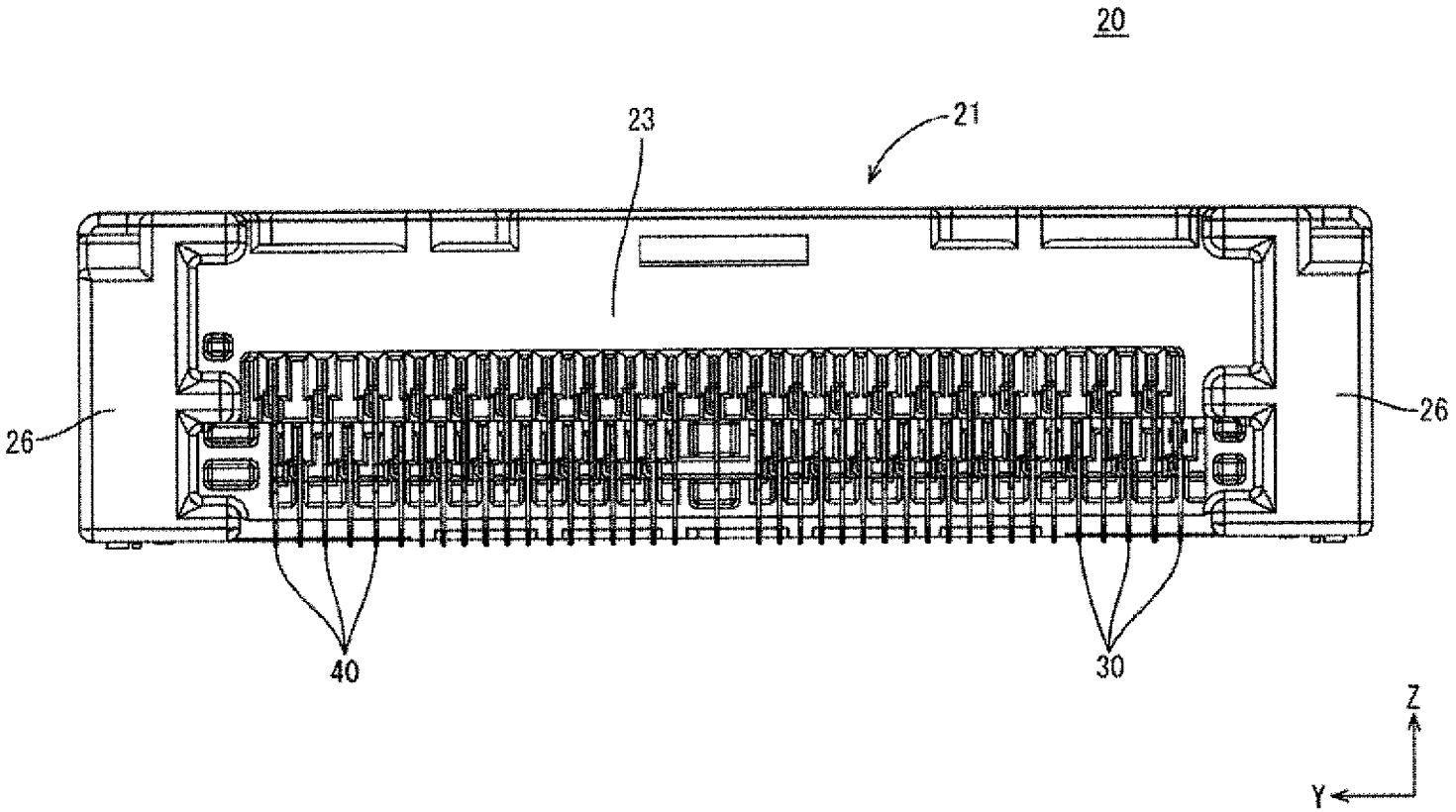
FIG. 6 is a back view showing the board connector.
Figure 7:
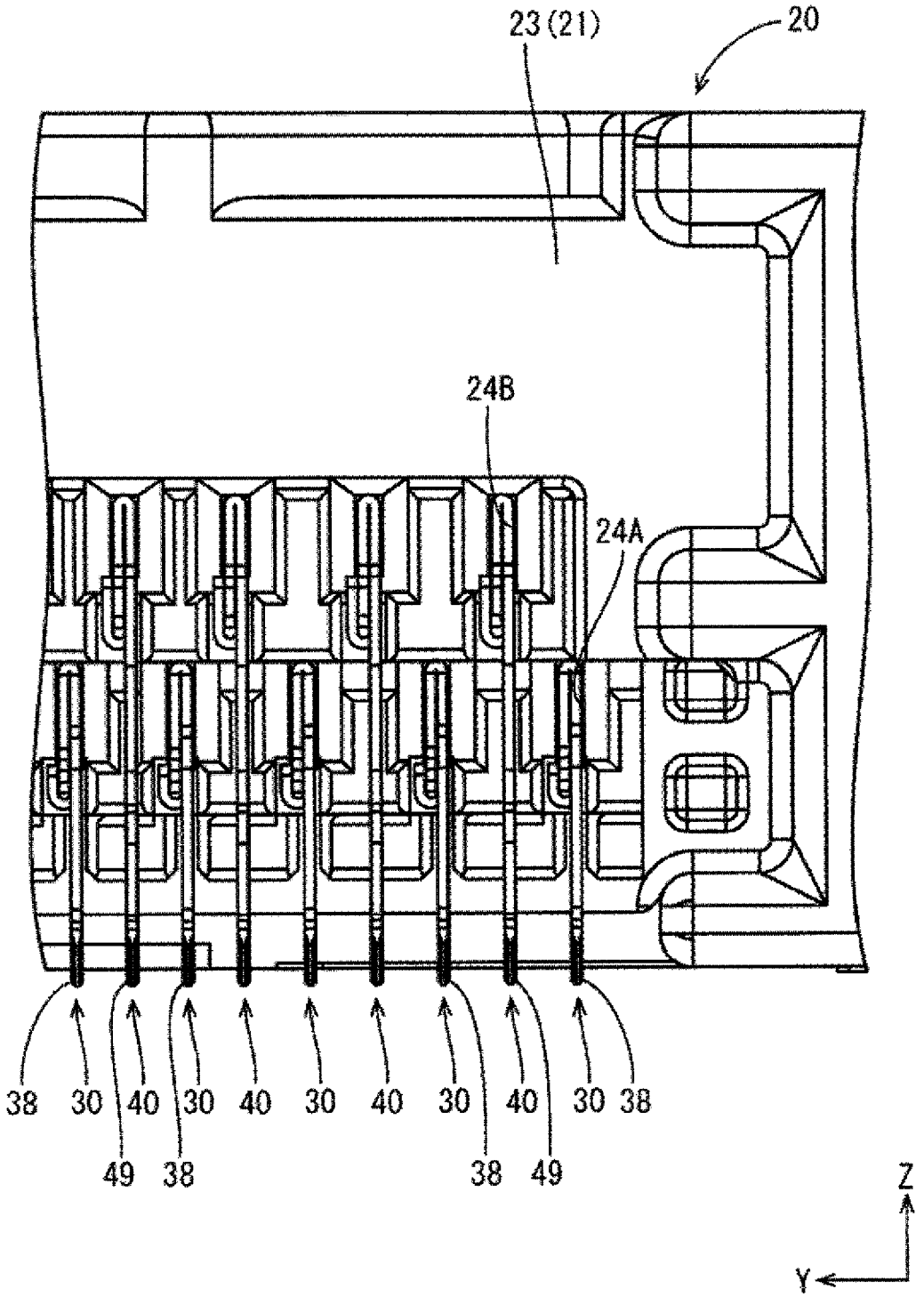
FIG. 7 is a view enlargedly showing a part of FIG. 6.
Figure 8:
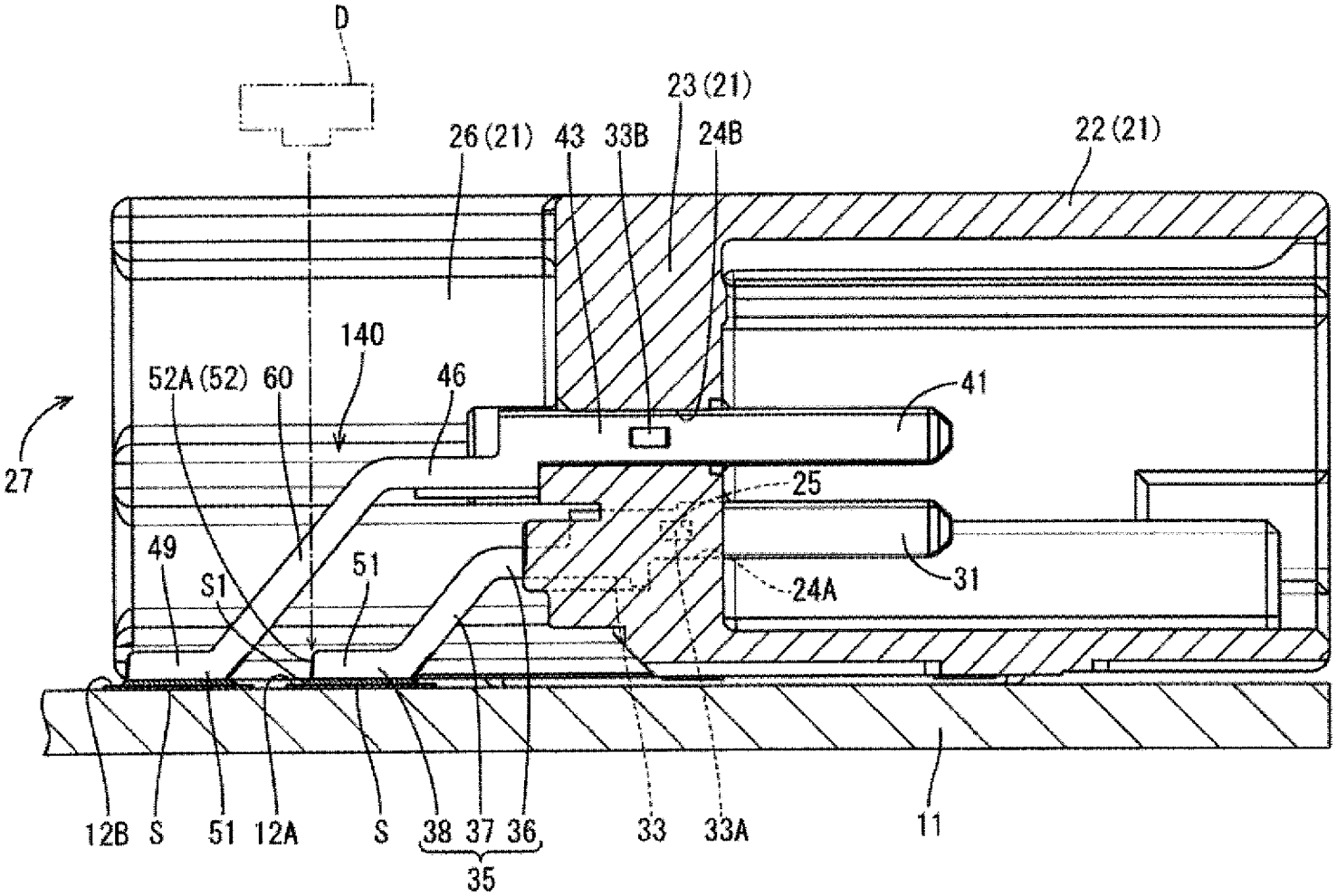
FIG. 8 is a section showing a connector with board as a comparative example.

As shown in FIGS. 3, 5 and 7, the board connector 20 includes a housing 21, first terminals 30 and second terminals 40. The housing 21 is made of synthetic resin and includes a receptacle 22 to be fit to an unillustrated mating connector, a wall 23 closing a base end of the receptacle 22 and two separation walls 26 disposed to face each other outside the first terminals 30 and the second terminals 40. The receptacle 22 is open forward.

The wall 23 closes a back end of the receptacle 22 and has a predetermined thickness. As shown in FIG. 3, the wall 23 through holes 24A, 24B penetrate the wall 23 in the front-rear direction. The through holes 24A, 24B are arranged in a zigzag pattern in upper and lower stages. The first terminals 30 are press-fit and fixed in the through holes 24A in the lower stage by various holding means (fixing means), such as molding, and the second terminals 40 are press-fit and fixed in the through holes 24B in the upper stage by various holding means (fixing means), such as molding. An open portion 27 opens up and down between the separation walls 26, and soldering to the board 11 can be inspected by an imaging device D, utilizing a space of the open portion 27 on an upper side. The first terminals 30 and the second terminals 40 are made of metal such as aluminum, aluminum alloy, copper or copper alloy.

Each first terminal 30 is a male terminal and includes a terminal contact portion 31 to be connected to a mating terminal, a first fixing portion 33 to be fixed in the wall 23 and a first extending portion 35 extending rearwardly of the wall 23. The terminal contact portion 31 forms a bar projecting into the receptacle 22. The first fixing portion 33 includes a locking projection 33A to be fit into a recess 25 in an inner wall of the through hole 24A. The locking projection 33A is locked into the recess 25 to position the first terminal 30.

The first extending portion 35 includes a first flat portion 36 extending rearward of the wall 23, an inclined portion 37 inclined obliquely down from a rear end part of the first flat portion 36 and a first connecting portion 38 connected to a lower end part of the inclined portion 37 for soldering to the first land 12A of the board 11. The first flat portion 36 and the first connecting portion 38 extend in a direction along a plate surface of the board 11.

The second terminal 40 is a male terminal and includes a terminal contact portion 41 to be connected to a mating terminal, a second fixing portion 43 to be fixed in the wall 23 and a second extending portion 45 extending rearward of the wall 23. The terminal contact portion 41 is a bar projecting into the receptacle 22. The second fixing portion 43 includes a locking projection 33B to be fit into a recess 25 in an inner wall of the through hole 24B. The locking projection 33B is locked into the recess 25 to position the second terminal 40.

The second extending portion 45 includes a second flat portion 46 extending rearward of the wall 23, a descending portion 47 descending from a rear end of the second flat portion 46 toward the board 11 and a second connecting portion 49 connected to a lower end of the descending portion 47 for soldering to the second land 12B of the board 11. The second flat portion 46 and the second connecting portion 49 extend parallel to the plate surface of the board 11. A bent portion 48 is formed on a vertically intermediate part of the descending portion 47 and is inclined obliquely down toward the second connecting portion 49. Additionally, the bent portion 48 is above the first connecting portion 38 of the first terminal 30 in the vertical direction and lateral to the first connecting portion 38 (region not overlapping the first connecting portion 38) in the lateral direction. A rear part of the bent portion 48 is disposed little behind the first connecting portion 38 in the front-rear direction. A side of the descending portion 47 above the bent portion 48 is bent orthogonally from a rear end of the second flat portion 46, and a side of the descending portion 47 below the bent portion 48 is inclined obliquely down toward the second connecting portion 49.

The first and second terminals 30, 40 are formed, for example, by applying stamping and bending to a thin metal plate material having a plating 51 on an outer surface. However, the first and second extending portions 35, 45 are formed only by stamping without being bent. In this way, dimensional accuracy of the first and second extending portions 35, 45 (and dimensional accuracy between the bent portions 48 and the first connecting portions 38) can be improved as compared to the case where the first and second extending portions 35, 45 are formed by bending. The plating 51 is left on both side surfaces of the first and second extending portions 35, 45 by stamping, and surfaces other than the side surfaces of the first and second extending portions 35, 45 (first and second terminals 30, 40) are cut surfaces 52 cut by a die and not formed with the plating 51. Thus, rear end surfaces (tips having fillets S1 adhered thereto and to be inspected for soldering) of the first and second connecting portions 38, 49 are also exposing portions 52A in which the cut surfaces 52 are exposed. The plating 51 can be, for example, made of tin, nickel or the like.

The connector with board 10 can be manufactured by applying solder paste to the lands 12A, 12B of the board 11. The board connector 20 then is placed at a predetermined position of the board 11 so that the first and second connecting portions 38, 49 of the first and second terminals 30, 40 are disposed on the corresponding lands 12A, 12B. The board 11 having the board connector 20 disposed thereon then is heated by being passed through an unillustrated reflow furnace to melt solder S. The solder S is cooled and solidified thereafter so that the first and second connecting portions 38, 49 are soldered to the corresponding lands 12A, 12B to form the connector with board 10.

Figure 9:
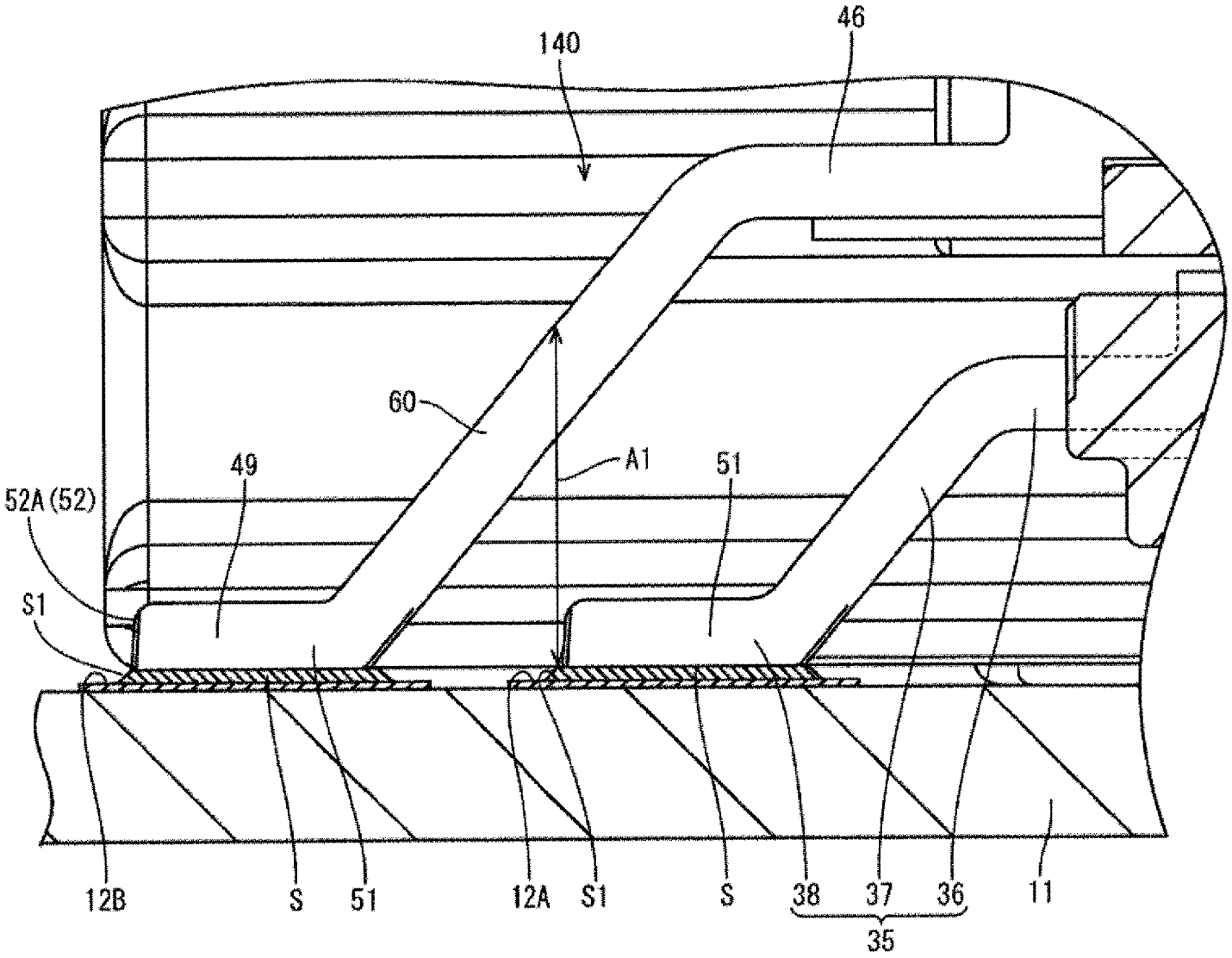
FIG. 9 is a view enlargedly showing a part of FIG. 8.

As shown in FIG. 3, soldering is inspected by imaging the fillet S1 adhering to the tip part of the first connecting portion 38 from above by the imaging device D, such as an image sensor. In the case of a second terminal 140 including no bent portion 48 in a second extending portion 60, as shown as a comparative example in FIG. 8, a difference A1 in depth of focus, which is a height difference between the fillet S1 of the solder S adhering to the tip part of the first connecting portion 38 (first terminal 30) and the second extending portion 60 at the same position in the front-rear direction becomes larger as shown in FIG. 9. Thus, there is a concern for a reduction in inspection accuracy due to image blurring caused by a difference in depth of focus from the second extending portion 60 of the second terminal 140 when the fillet S1 is brought into focus.

Figure 4:
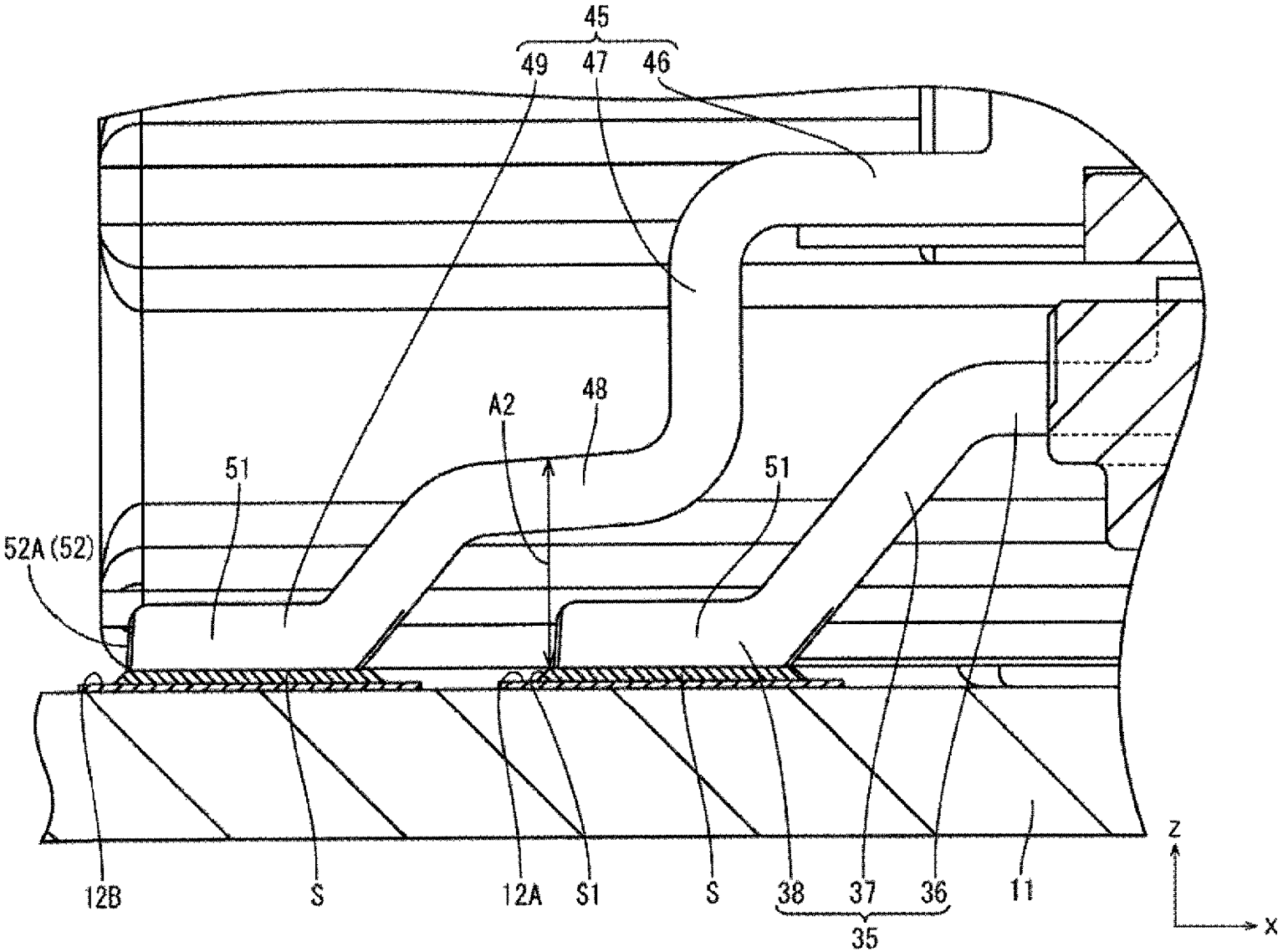
FIG. 4 is a view enlargedly showing a part of FIG. 3.

In contrast, in this embodiment, even if the fillet S1 at the position of the tip of the first connecting portion 38 (first terminal 30) is brought into focus, as shown in FIG. 3, a difference A2 (A2<A1) in depth of focus, which is a height dimensional difference in the Z direction between the fillet S1 adhering to the tip part of the first connecting portion 38 (first terminal 30) and the bent portion 48 of the second extending portion 45 is reduced by providing the second extending portion 45 with the bent portion 48, as shown in FIG. 4. Thus, image blurring is less likely and the accuracy of the inspection for soldering can be enhanced Functions and effects of this embodiment are described.

The board connector 20 is provided with the first terminals 30, the second terminals 40 and the housing 21 including the wall 23 for holding the first terminals 30 and the second terminals 40. The first terminal 30 includes the first extending portion 35 extending out from the wall 23, and the second terminal 40 includes the second extending portion 45 extending out from the wall 23. The first extending portion 35 includes the first connecting portion 38 that can be soldered to the first land 12A of the board 11, and the second extending portion 45 includes the second connecting portion 49 that can be soldered to the second land 12B of the board 11 at a position more distant from the wall 23 than the first connecting portion 38. Additionally, the bent portion 48 is bent to approach the first connecting portion 38 at a position not overlapping the first connecting portion 38.

According to this embodiment, the bent portion 48 of the second extending portion 45 reduces the difference in depth of focus between the soldered part of the first connecting portion 38 and the second extending portion 45 during the inspection for the soldering on the surface of the board 11. Thus, a reduction in inspection accuracy due to the difference in depth of focus at the time of the inspection for soldering can be suppressed.

Further, the bent portion 48 extends along the extending direction of the first connecting portion 38 so that the difference in depth of focus can be reduced in a region within an extending range of the bent portion 48. Therefore, a reduction in inspection accuracy due to the difference in depth of focus can be suppressed while the first and second terminals 30, 40 are insulated from each other.

Further, the first connecting portion 38 includes the plated portion 51 by having the outer surface plated and the exposing portion 52A in which the metal cut surface 52 is exposed, and the plated portion 51 is soldered. Thus, better soldering is possible as compared to the soldering of the cut metal surface 52.

The invention is not limited to the above described and illustrated embodiment. For example, the following embodiments also are included in the scope of the invention.

Although the first and second terminals 30, 40 are male terminals, there is no limitation to this and these terminals may be female terminals.

The shape of the bent portion 48 is not limited to that of the above embodiment. The bent portion 48 may be at least shaped to reduce the height difference (difference in depth of focus) between the first connecting portion 38 and the second extending portion.

Although there are two types of terminals, i.e. the first terminals 30 and the second terminals 40, there is no limitation to this and there may be three or more types of terminals. For example, third terminals extending farther rearward than the second extending portions of the second terminals may be arranged in a zigzag pattern. Further, the lands and the terminals may be arranged in a pattern different from the zigzag pattern.

LIST OF REFERENCE SIGNS

10: connector with board
11: board
12A: first land
12B: second land
20: board connector
21: housing
22: receptacle
23: wall
24A, 24B: through hole
25: recess
26: separation wall
27: open portion
30: first terminal
31: terminal contact portion
33: first fixing portion
33A, 33B: locking projection
35: first extending portion
36: first flat portion
37: inclined portion
38: first connecting portion
40, 140: second terminal
41: terminal contact portion
43: second fixing portion
45: second extending portion
46: second flat portion
47: descending portion
48: bent portion
49: second connecting portion
51: plated portion
52: cut surface
52A: exposing portion
60: second extending portion
A1, A2: difference in depth of focus
D: imaging device
S1: fillet
S: solder

What is claimed is:

1. A board connector:

comprising:

a first terminal;

a second terminal disposed laterally of the first terminal; and a housing including a wall for holding the first and second terminals, wherein:

the first terminal includes a first extending portion extending out from the wall, the second terminal includes a second extending portion extending out from the wall, the first extending portion includes a rear end that defines a part of the first terminal farthest from the wall and a first connecting portion forward of and adjacent to the rear end, the first connecting portion being solderable to a first land of a board so that a solder fillet adjacent the rear end of the first extending portion is visible from above, the second extending portion includes a second connecting portion solderable to a second land of the board, the second connecting portion being at a position more distant from the wall than the rear end of the first connecting portion, the second connecting portion further including a sloped portion inclined to approach the second connecting portion at a position laterally of the first connecting portion, at least part of the sloped portion of the second connecting portion of the second terminal and at least part of the first connecting portion of the first terminal are at equal distances from the wall of the housing, and the first connecting portion includes opposite outer surfaces extending forward from the rear end and up from the board, the outer surfaces being plated to define a plated portion, and an exposed portion with an exposed cut metal surface being defined at the rear end of the first extending portion, and the plated portion is soldered.

2. An assembly, comprising:

a board with a mounting surface having first and second lands formed thereon; and a board connector, the board connector including:

a first terminal;

a second terminal disposed laterally of the first terminal; and a housing mounted on the mounting surface of the board and including a wall for holding the first and second terminals, the wall projecting away from the mounting surface of the board, wherein:

the first terminal includes a first extending portion extending out from the wall, the second terminal includes a second extending portion extending out from the wall, the first extending portion includes a rear end that defines a part of the first terminal farthest from the wall and a first connecting portion forward of and adjacent to the rear end, the first connecting portion being soldered to the first land of the board so that a solder fillet adjacent the rear end of the first extending portion is visible from above the board, the second extending portion includes a second connecting portion solderable to the second land of the board, the second connecting portion being at a position more distant from the wall than the rear end of the first connecting portion, the second connecting portion further including a sloped portion inclined to approach the second connecting portion at a position laterally of the first connecting portion, at least part of the sloped portion of the second connecting portion of the second terminal and at least part of the first connecting portion of the first terminal are at equal distances from the wall of the housing, and the first connecting portion includes opposite outer surfaces extending forward from the rear end and up from the board, the outer surfaces being plated to define a plated portion, and an exposed portion with an exposed cut metal surface being defined at the rear end of the first extending portion, and the plated portion is soldered.

* * * * *